US010609969B2

(12) United States Patent
Castellano et al.

(10) Patent No.: US 10,609,969 B2
(45) Date of Patent: Apr. 7, 2020

(54) ONE-PIECE SWIMSUIT HAVING MAGNETIC FASTENING SYSTEM AND METHOD OF USING SAME

(71) Applicant: FASTEN SWIM GROUP, LLC, New York, NY (US)

(72) Inventors: Alexis Castellano, Holmdel, NJ (US); Jill Slater, Morganville, NJ (US)

(73) Assignee: FASTEN SWIM GROUP, LLC, New York, NY (US)

( * ) Notice: Subject to any disclaimer, the term of this patent is extended or adjusted under 35 U.S.C. 154(b) by 967 days.

(21) Appl. No.: 14/947,287

(22) Filed: Nov. 20, 2015

(65) Prior Publication Data

US 2016/0143373 A1 May 26, 2016

Related U.S. Application Data

(60) Provisional application No. 62/082,195, filed on Nov. 20, 2014.

(51) Int. Cl.
*A41D 11/00* (2006.01)
*A41D 7/00* (2006.01)

(52) U.S. Cl.
CPC ..... *A41D 11/00* (2013.01); *A41D 7/00* (2013.01); *A41D 2300/324* (2013.01); *A41D 2400/44* (2013.01)

(58) Field of Classification Search
CPC .... A41D 11/00; A41D 7/00; A41D 2300/324; A41D 2400/44
See application file for complete search history.

(56) References Cited

U.S. PATENT DOCUMENTS 436,607 A * 9/1890 Litle ..... A41B 9/02 602/68
599,408 A * 2/1898 Uppercu ..... A41D 7/00 2/67

(Continued)

FOREIGN PATENT DOCUMENTS

WO 1995002340 1/1995
WO 96/18315 6/1996

OTHER PUBLICATIONS

Examiner Clint A. Samuel, "Non-Final Office Action", U.S. Appl. No. 29/530,014, dated Jun. 15, 2017, 8 pp.

(Continued)

*Primary Examiner* — Richale L Quinn
(74) *Attorney, Agent, or Firm* — Morrison & Foerster LLP

(57) ABSTRACT

A one-piece swimsuit has a tubular member having a first panel and second panel. The first panel extends to a lower edge having a first band portion. A flap portion is connected to the second panel and extends downwardly past the plane of the lower edge to an upper edge having a second band portion. The flap portion has an opened and closed position. The swimsuit includes a fastening system having first magnetic means for releasably fastening the flap portion in the closed position, and second magnetic means for releasably fastening the flap portion in the opened position. The first and second magnetic means include the first and second band portions respectively, a thin strip integrally coupled within each band portion, a plurality of magnetic elements, a plurality of spaced pockets attached to each strip for encasing each magnetic element, and a cover layer bonded to the strip.

16 Claims, 7 Drawing Sheets

(56) References Cited

U.S. PATENT DOCUMENTS 1,954,526 A * 4/1934 Holahan ..... A41D 7/00 2/67
2,335,658 A * 11/1943 Fishbein ..... A41D 7/005 2/403
2,463,309 A 3/1949 Prince
2,857,600 A * 10/1958 Finn ..... A41D 7/00 2/67
3,036,574 A * 5/1962 Nellie ..... A41D 7/00 2/67
4,447,911 A * 5/1984 Marcellaro ..... A41D 13/02 2/79
4,457,025 A 7/1984 Meryash
4,607,369 A 8/1986 Craig
4,640,287 A * 2/1987 Anderson ..... A44B 18/00 450/36
4,835,795 A * 6/1989 Lonon ..... A41B 9/007 2/408
5,561,858 A * 10/1996 Poirier ..... A41B 13/00 2/408
5,692,239 A * 12/1997 Lewis ..... A41F 19/005 2/115
6,016,569 A * 1/2000 Everett ..... A41D 7/00 2/408
6,035,439 A * 3/2000 Chin ..... A41B 9/08 2/408
6,324,699 B1 * 12/2001 Cosmah ..... A41B 11/14 2/239
6,374,412 B1 * 4/2002 Canlas ..... A41B 9/007 2/67
6,434,801 B2 * 8/2002 Grunberger ..... A41F 1/002 24/114.6
6,964,065 B2 11/2005 Stevenson
D544,678 S 6/2007 Fitagerald
7,322,967 B2 * 1/2008 Kondo ..... A61F 13/42 604/385.11
D595,480 S 7/2009 Giugliano
D600,881 S 9/2009 Naylor
D601,326 S 10/2009 DiFrancesco
D613,036 S 4/2010 Waldman
7,753,759 B2 7/2010 Pintor et al.
D627,538 S 11/2010 Naylor
7,908,671 B2 * 3/2011 Gaugler ..... A41D 15/002 2/69.5
D639,019 S * 6/2011 Perryman ..... D2/731
D648,098 S * 11/2011 Mitchell ..... D2/712
8,087,098 B2 * 1/2012 Kimberly ..... A41B 9/001 2/227
8,108,947 B2 * 2/2012 Beauvais ..... A41B 9/08 128/889
8,181,273 B2 * 5/2012 Kane ..... A61F 13/49 2/111
8,479,320 B2 * 7/2013 Swafford ..... A41D 1/00 2/227
8,522,362 B1 * 9/2013 Stones ..... A41D 15/00 2/67
D698,521 S * 2/2014 Ott ..... D2/745
8,745,766 B2 6/2014 Tarrant et al.
8,918,915 B2 * 12/2014 Caulfield ..... A41D 7/005 2/67
9,210,953 B2 * 12/2015 Horton ..... A41B 1/10
9,549,580 B2 1/2017 Horton
9,560,889 B1 2/2017 White
D787,783 S 5/2017 Mckinney-Brown
9,750,287 B2 * 9/2017 Cohen Larren ..... A41C 1/00
D801,633 S * 11/2017 Slater ..... D2/731
D833,113 S * 11/2018 Nguyen ..... D2/745
2002/0062511 A1 * 5/2002 Lee ..... A41D 13/1263 2/78.2
2006/0026734 A1 2/2006 Fitzgerald
2006/0166600 A1 7/2006 Ravoiu et al.
2008/0256676 A1 10/2008 DiLorenzo
2012/0174283 A1 7/2012 Peters et al.
2012/0174285 A1 7/2012 Williams et al.
2012/0266347 A1 10/2012 DiLorenzo
2013/0180024 A1 7/2013 Flick
2013/0269077 A1 10/2013 Anderson
2014/0130228 A1 5/2014 Horton
2014/0130231 A1 5/2014 Horton
2014/0143985 A1 * 5/2014 Horton ..... A41B 1/10 24/303
2014/0215692 A1 8/2014 Mohammadian
2014/0257231 A1 9/2014 Wang et al.
2015/0173426 A1 6/2015 Lambert
2015/0173427 A1 6/2015 Sawyer
2016/0037837 A1 2/2016 Ferrara
2016/0095367 A1 4/2016 Curran
2016/0113329 A1 4/2016 Baker
2016/0143373 A1 * 5/2016 Castellano ..... A41D 11/00 2/67
2016/0206013 A1 7/2016 Marshall et al.
2017/0196276 A1 7/2017 Park
2017/0303601 A1 10/2017 Lopina DeMaria
2018/0084842 A1 3/2018 Johnson et al.

OTHER PUBLICATIONS

Fasten, "Fasten Rainbow Hearts Swimsuit", Website, Jun. 15, 2017, Publisher: https://www.fastenswim.com/products/rainbow-hearts-swimsuit, 4 pp.
Fasten located at http://web.archive.org/web/20171004163347//https://www.fastenswim.com/ visited on Mar. 7, 2019 (6 pages).
"Coral Orange Swimsuit—MacKeene" (May 11, 2011) located at https://www.amazon.co.uk/MACKEENE-Coral-Orange-Swimsuit-MacKeene/dp/B005KH921G visited Mar. 7, 2019 (3 pages).
"Introducing Ultrakini-Magnetic Three-Piece Swimwear" (May 18, 2015) located https://www.youtube.com/watch?v=1TItApRwXms visited Mar. 7, 2019 (2 pages).
"Patentability Search Report", dated Nov. 14, 2014.
The Underbib, "http://theunderbib.com/about-underbib-baby/", downloaded Jun. 14, 2016.
Magnificent Baby, "http://www.magnificentbaby.com/custompages/magnificentbaby/Baby-and-Toddler-Raincoats-at-CID347.aspx", downloaded Jun. 14, 2016.
Magnificent Baby, "http://www.magnificentbaby.com/custompages/magnificentbaby/Burrito-Bodysuits-CID264.aspx", downloaded Jun. 14, 2016.
Magnificent Baby, "http://www.magnificentbaby.com/custompages/magnificentbaby/Footies-CID388.aspx", downloaded Jun. 14, 2016.
Magnificent Baby, "http://www.magnificentbaby.com/instructions-magnificent-baby-ccid_82.aspx", downloaded Jun. 14, 2016.
The Underbib, "http://theunderbib.com/product-category/underbib-baby/", downloaded Jun. 14, 2016.

* cited by examiner

ONE-PIECE SWIMSUIT HAVING MAGNETIC FASTENING SYSTEM AND METHOD OF USING SAME

CROSS-REFERENCES TO RELATED APPLICATIONS

This application claims the benefit of provisional patent application Ser. No. 62/082,195 filed in the United States Patent and Trademark Office on Nov. 20, 2014, the entire disclosure of which is incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE EFS-WEB

Not applicable.

STATEMENT REGARDING PRIOR DISCLOSURES BY THE INVENTOR OR A JOINT INVENTOR

Not applicable.

SEQUENCE LISTING

Not applicable.

BACKGROUND OF THE INVENTION

Field of the Invention

This invention relates generally to swimwear, and more particularly, to a one-piece swimsuit for young girls having a strong, secure, inconspicuous, and water-resistant fastening system that provides for easy bathroom use while still comfortably conforming to a young girl's body.

Description of the Related Art

There have been numerous attempts to provide garments which are intended to provide convenient and comfortable clothing. However, there remains a need for a one-piece garment for wear by young girls, which is more convenient and adaptable for swimming and other activities.

In the case of all presently known swimwear, body suits, and leotards for young girls, taking a bathroom visit requires removing at least a portion the garment. In particular, a one-piece swimsuit must be entirely removed in order to use the bathroom. After the wet swimsuit is removed, it is extremely challenging for a child to put back on. Plus, it often rests on the dirty bathroom floor while the child uses the bathroom.

Two-piece swimsuits with separate top and bottom portions have been designed to avoid the necessity of having to remove the entire swimsuit. However, the bottom portion of these swimsuits must still be removed and put back on during a bathroom visit leaving the bottom portion susceptible to the challenges above. In addition, two-piece swimsuits are typically ill-fitting for a young girl's growing body, they are loose and saggy exposing portions of the girl's midriff and breasts, and the styles are not often age appropriate.

For all of the above reasons, it is worthwhile to provide a one-piece swimsuit capable of easily opening and closing for convenient bathroom visits. Since the swimsuit of the present invention is intended to be worn by young girls, it is necessary to provide a fastening system that is easily released, but remains strong, secure, and inconspicuous when fastened.

Conventional one-piece garments including swimsuits, body suits, and leotards for young girls, are sewn together, typically at the crotch. In the case of infant and child onsies, portions must be fastened together to secure the item to the infant or child, which typically include a variety of mechanical devices to facilitate this fastening. Hooks, buttons, hook and loop, snaps, zippers, latches, buckles, and the like are some examples of this hardware. Many considerations are contemplated when choosing appropriate hardware including function, operation, strength, ease of use for young children, and style or aesthetics.

Most known prior art utilizes, hook and loop (VELCRO), snap or tie fasteners, and zippers. However, these known mechanism will not allow the swimwear to be worn comfortably, nor are they able to become wet without restricting their use. Furthermore, most, if not all, of the hardware is difficult and inconvenient for young girls to use on their own, especially when the connection is behind their back. The hardware also require exact positioning for a secure connection, is not inconspicuous or concealable within fabric material, and is not easily combined with conventional swimsuit material. In particular, hook and loop is known to pill swimsuit material and will easily tear from the force of a young girl pulling to release the fastener.

Moreover, with little resistance to the forces inherent with becoming wet and exposed to sand, salt water and chlorine, hook and loop and other hardware mechanisms are susceptible to coming unfastened unexpectedly.

The present invention is the first swimsuit adapted for use by young girls which can become wet and quickly dry, and provides all the advantages of a one-piece swimsuit, with increased convenience, operation, function, strength, and style.

It is, therefore, a primary object of the present invention to provide a one-piece swimsuit garment having a strong, secure, and inconspicuous fastening system.

It is another object of the present invention to provide a one-piece swimsuit adaptable for wear by a young girl.

It is another object of the present invention to provide a one-piece swimsuit having a fastening system convenient for use by a young girl.

It is another object of the present invention to provide a one-piece swimsuit having a tubular member for fully covering the torso of a child and a detachable flap portion extending from the tubular member for covering the buttocks, pelvis and abdomen area of the child.

It is another object of the present invention to provide a fastening system having first means for releasably fastening the flap portion in a closed position, and second means for releasable fastening the flap portion in an opened position.

It is another object of the present invention to provide a fastening system that conveniently fastens the flap portion to the back of the swimsuit so it is completely out of the way during a bathroom visit.

It is another object of the present invention to provide first, second, and third magnetic assemblies, wherein the first magnetic assembly is integrally coupled to the front of the tubular member, and the second magnetic assembly is integrally coupled to the flap portion, such that the second magnetic assembly is releasably fastened to the first magnetic assembly when the flap portion is in the closed position, and the second magnetic assembly is releasably fastened to the third magnetic assembly when the flap portion is in the opened position.

It is another object of the present invention to provide a one-piece swimsuit wherein the closed position the first magnetic assembly is releasably fastened in substantial alignment on top of the second magnetic assembly such that the second magnetic assembly is concealed from view.

It is another object of the present invention to provide a one-piece swimsuit wherein the closed position the second magnetic assembly is releasably fastened in substantial alignment on top of the first magnetic assembly such that the first magnetic assembly is concealed from view.

It is another object of the present invention to provide first and second magnetic assemblies having band portions having at least one magnetic element disposed and concealed therein.

It is another object of the present invention to provide first and second magnetic assemblies having elongated thin flexible strips disposed therein and having a plurality of magnetic elements securely spaced along the strips.

It is another object of the present invention to provide a cover layer around the flexible strip within the first and second magnetic assemblies for adding a degree of stiffness and eliminating movement of the strip within the bands.

It is another object of the present invention to provide a one-piece swimsuit having a waterproof casing or pocket for housing magnetic elements therein for providing the magnetic element with a high resistance to potential corrosion.

It is another object of the present invention to provide further fastening strength to the swimsuit by the inclusion of a pair of mechanical snap fasteners coupled within the band of the tubular member and band of the flap portion.

BRIEF SUMMARY OF THE INVENTION

In accordance with one aspect of the present invention, a one-piece garment is provided having a tubular member having a first panel and a second panel for substantially covering a torso of a wearer. The first panel extends to a lower edge. The garment includes a flap portion having an upper edge. The flap portion extends downwardly from the second panel of the tubular member past the plane of the lower edge to the upper edge. The flap portion has an opened and a closed position. The garment includes first means for releasably fastening the flap portion in the closed position, wherein the upper edge of the flap portion releasably engages the lower edge of the tubular member.

The first means is a pair of complimentary magnetic assemblies including a first magnetic assembly integrally coupled to the first panel of the tubular member, and a second magnetic assembly integrally coupled to the flap portion.

The first magnetic assembly has a first thin flexible strip having magnetic properties integrally formed within the lower edge of the first panel of the tubular member.

The second magnetic assembly has a second thin flexible strip having magnetic properties integrally formed within the upper edge of the flap portion, for fastening in the closed position the upper edge of the flap portion to the lower edge of the first panel of the tubular member.

The first and second strips provide overlapping engagement and attraction, such that the lower edge of the first panel of the tubular member substantially overlaps and conceals the upper edge of the flap portion in the securely closed position.

The second means releasably fastens the flap portion in the opened position, wherein the upper edge of the flap portion is releasably engaged to the second panel of the tubular member.

The second means is a pair of complimentary magnetic assemblies including a third magnetic assembly having magnetic properties integrally coupled within the second panel of the tubular member.

The second magnetic assembly is releasably engaged to the third magnetic assembly when the flap portion is in the opened position.

The one-piece swimsuit further includes at least one first snap fastener secured to the first panel, and at least one second snap fastener secured to the flap portion, wherein the first snap fastener removably engages the second snap fastener to securely fasten the lower edge of the first panel to the upper edge of the flap portion when the flap portion is in the closed position.

In accordance with an additional embodiment, a one-piece swimsuit for a female child having a torso and abdomen is provided. The swimsuit includes a tubular member having a first panel and a second panel for substantially covering the torso of the child. The first panel extends to a lower edge having a first band portion having an underside and extending transversely across the abdomen of the child. The swimsuit includes a flap portion connected to the second panel of the tubular member and extends downwardly past the plane of the lower edge to an upper edge. The flap portion has an opened and a closed position. The upper edge has a second band portion having a topside and a bottom side. The swimsuit includes a fastening system for releasably fastening the flap portion in the opened and closed positions. The system includes first means for releasably fastening the flap portion in the closed position, and second means for releasably fastening the flap portion in the opened position. Wherein the closed position the first band portion is substantially aligned with the second band portion. Wherein the opened position at least a portion of the second band portion is releasably fastened to the second panel of the tubular member.

The first means is a pair of complimentary magnetic assemblies including a first magnetic assembly integrally coupled to the first band portion, and a second magnetic assembly integrally coupled to the second band portion.

The first magnetic assembly includes a first elongated thin flexible strip integrally coupled within the first band portion and having a plurality of spaced first magnetic elements. The spaced first magnetic elements are encased within pockets coupled to the first elongated thin flexible strip.

The second magnetic assembly includes a second elongated thin flexible strip integrally coupled within the second band portion and having a plurality of spaced second magnetic elements. The spaced second magnetic elements are encased within pockets coupled to the second elongated thin flexible strip.

The spacing of the plurality of first magnetic elements corresponds to the spacing of the plurality of second magnetic elements.

In the closed position the topside of the second band portion is substantially aligned with the underside of the first band portion, such that the second band portion is substantially concealed under the first band portion.

The first band portion includes an outer side, wherein the closed position the bottom side of the second band portion is substantially aligned with the outer side of the first band portion, such that the first band portion is substantially concealed under the second band portion.

The one-piece swimsuit further includes at least one first snap fastener secured to the underside of the first band portion, and at least one second snap fastener secured to the topside of the second band portion, wherein the first snap fastener removably engages the second snap fastener to securely fasten the lower edge of the first panel to the upper edge of the flap portion when the flap portion is in the closed position.

In accordance with an additional embodiment a one-piece swimsuit for a female child having a torso and abdomen is provided. The swimsuit includes a tubular member having a front panel and a back panel for substantially covering the torso of the child. The front panel extends to a lower edge having a first band portion. The first band portion having an outer side and an underside extending transversely across the abdomen of the child. The swimsuit includes a flap portion having an upper edge. The flap portion is connected to the back panel and extends downwardly past the plane of the lower edge to the upper edge. The flap portion has an opened and closed position. The upper edge has a second band portion having a topside and a bottom side. The swimsuit includes a fastening system for releasably fastening the flap portion in the opened and closed positions. The system has a first, second, and third magnetic assembly, wherein the second magnetic assembly is releasably fastened to the first magnetic assembly when the flap portion is in the closed position. The second magnetic assembly is releasably fastened to the third magnetic assembly when the flap portion is in the opened position. The first magnetic assembly has at least one first magnetic element disposed within the first band portion. The second magnetic assembly has at least one second magnetic element disposed within the second band portion. The third magnetic assembly has at least one third magnetic element disposed within the back panel of the tubular member. The first band portion is magnetically securable to the second band portion via at least one first and second magnetic elements. The second band is magnetically securable to the third magnetic element via at least one second and third magnetic elements.

The back panel includes a top edge, wherein at least one third magnetic element is centrally disposed adjacent the top edge of the back panel.

The front panel is attached to the back panel along a first side seam and a second side seam.

The flap portion has opposed lateral edges wherein the closed position the lateral edges form leg openings.

The first magnetic assembly includes a first elongated thin flexible strip integrally coupled within the first band portion and having at least one first magnetic element coupled thereto. At least one first magnetic element is encased within a pocket coupled to the first elongated thin flexible strip.

The second magnetic assembly includes a second elongated thin flexible strip integrally coupled within the second band portion and having at least one second magnetic element coupled thereto. At least one second magnetic element is encased within a pocket coupled to the second elongated thin flexible strip.

In the closed position the first magnetic assembly is releasably fastened on top of the second magnetic assembly such that the underside of the first band portion is substantially aligned with the topside of the second band portion.

In the closed position the first magnetic assembly is releasably fastened underneath the second magnetic assembly such that the bottom side of the second band portion is substantially aligned with the outer side of the first band portion.

At least one first snap fastener is secured to the underside of the first band portion, and at least one second snap fastener secured to the topside of the second band portion. The first snap fastener removably engages the second snap fastener to securely fasten the lower edge of the first panel to the upper edge of the flap portion when the flap portion is in the closed position.

In accordance with an additional embodiment a system for fastening two portions of a one-piece swimsuit is provided. The swimsuit includes a first portion, a second portion, a flap portion, a first magnetic assembly fixed to the first portion, and a second magnetic assembly fixed to the flap portion. The first magnetic assembly cooperates with the second magnetic assembly to securely fastening the first and flap portions of the swimsuit. The cooperating magnetic assemblies are magnetically opposable and each include a band portion, a thin flexible strip integrally coupled within the band portion, and at least one spaced magnetic element fastened to the strip.

At least one pocket is included for encasing at least one magnetic element therein, such that the pocket is attached to the thin flexible strip.

The system further includes a cover layer bonded to the thin flexible strip.

In accordance with an additional embodiment a method of using a one-piece swimsuit garment is provided. The steps include providing a tubular member having a first panel extending to a lower edge, a second panel, and a flap portion having an upper edge and extending downwardly from the second panel past the plane of the lower edge to the upper edge. Next, providing a fastening system including a first magnetic assembly integrally coupled to the lower edge of the first panel, a second magnetic assembly integrally coupled to the upper edge of the flap portion, and a third magnetic assembly integrally coupled to the second panel. Then, releasably fastening in a closed position the upper edge of the flap portion to the lower edge of the first panel of the tubular member. Finally, releasably fastening in an opened position the upper edge of the flap portion to the second panel of the tubular member.

BRIEF DESCRIPTION OF THE SEVERAL VIEWS OF THE DRAWINGS

To these and to such other objects that may hereinafter appear, the present invention relates to a one-piece swimsuit for young girls having a strong, secure, inconspicuous, and water-resistant fastening system that provides for easy bathroom use while still comfortably conforming to a young girl's body, as described in detail in the following specification and recited in the annexed claims, taken together with the accompanying drawings, in which like numerals refer to like parts in which:

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

FIGS. 1-8 illustrate a garment 10, preferably a swimsuit, for wear by a female child. The purpose of which is to allow young girls to easily open and close the garment for convenient and efficient bathroom visits and diaper changes, while still providing a one-piece garment that offers maximum coverage and comfort.

Preferably, the swimsuit 10 is comprised of fabric material that is tight fitting, integrally coupled to the lining 100, and includes stretchable synthetic or synthetic blend material not limited to nylon, polyester, spandex, polyurethane and various blends thereof.

Figure 1:
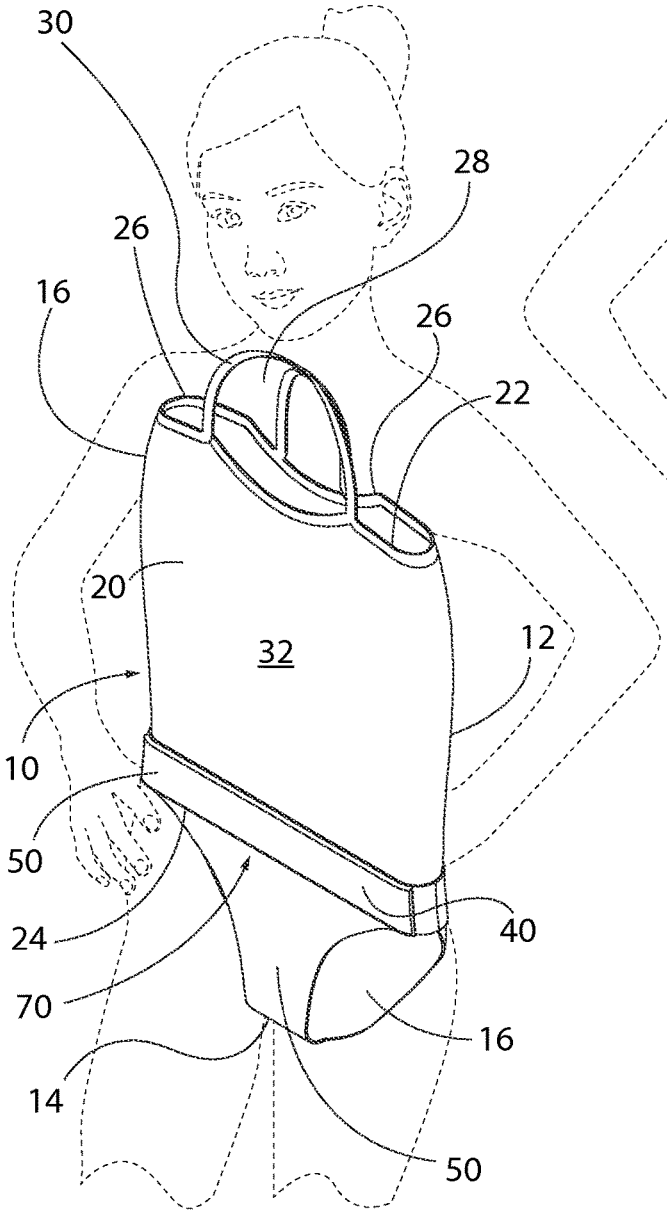
FIG. 1 is a perspective front view of a child wearing a swimsuit having a fastening system according to the preferred embodiment of the present invention.
Figure 2:
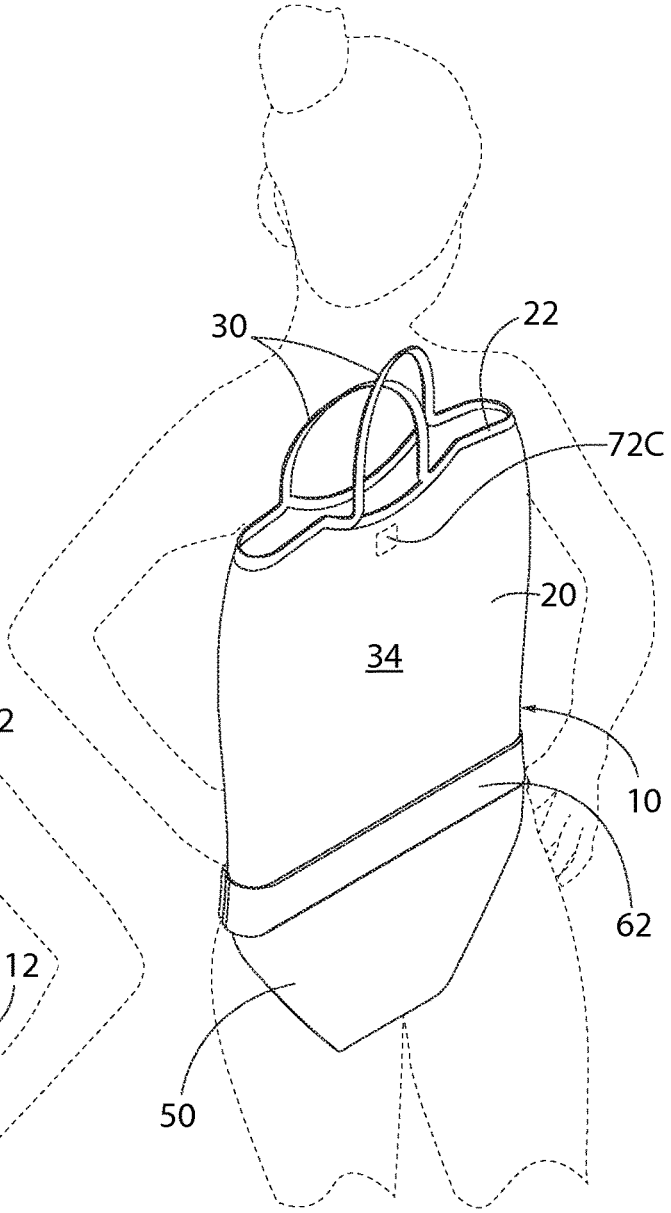
FIG. 2 is a perspective rear view of the child wearing the swimsuit having the fastening system according to the preferred embodiment of the present invention.

Referring to FIGS. 1-2, the swimsuit 10 is a one-piece garment that covers the entire torso 12, including the pelvis, abdomen and breasts, from the crotch 14 to the upper chest area 16. In its broadest context, the garment 10 includes a main body section 20 and a detachable crotch flap portion 50 removably fastened together by a strong, secure, and inconspicuous fastening system 70, which when fastened together forms leg openings 16. Preferably, the main body section 20 and flap portion 50 include a conventional fabric lining 100. When the swimsuit is properly applied, the child can swim, sunbathe, or engage in any activity or sport for which swimsuits are used. When the child has to use the bathroom, she does not have to remove the entire swimsuit. Rather, she just releases the fastening system 70 from the front of the swimsuit and swings the flap portion 50 down and between her legs and fastens the flap portion to the back of the swimsuit so it is completely out of the way (shown in FIG. 8).

The main body section 20 is a tubular configuration for enclosing the torso 12 of the child. The main section 20 includes a top edge 22 and a lower edge 24. At the top edge 22 of the main body section 20 are two arm openings 26 and a central opening 28 positioned therebetween. Two shoulder straps 30 are formed between the arm and central openings 26, 28. When the swimsuit is worn the child's head and neck are positioned through the central opening 28, while the arms fit through the arm openings 26.

Figure 3:
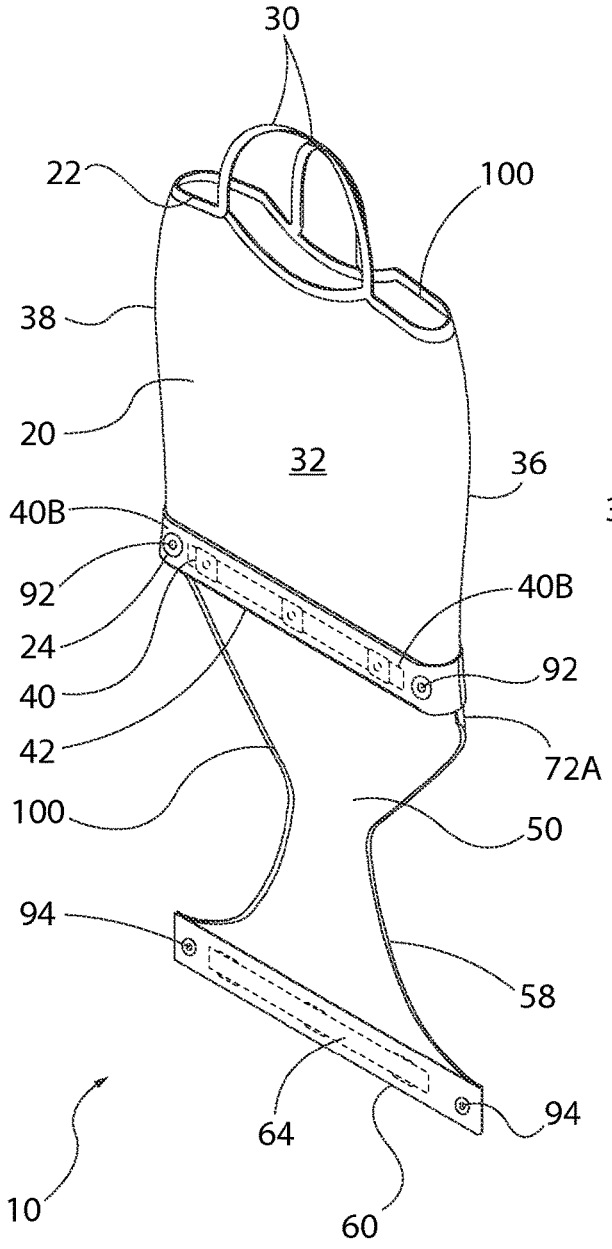
FIG. 3 is a perspective front view of the swimsuit showing the fastening system including a first magnetic assembly for releasably fastening a flap portion in a closed position, according to the preferred embodiment of the present invention.
Figure 4:
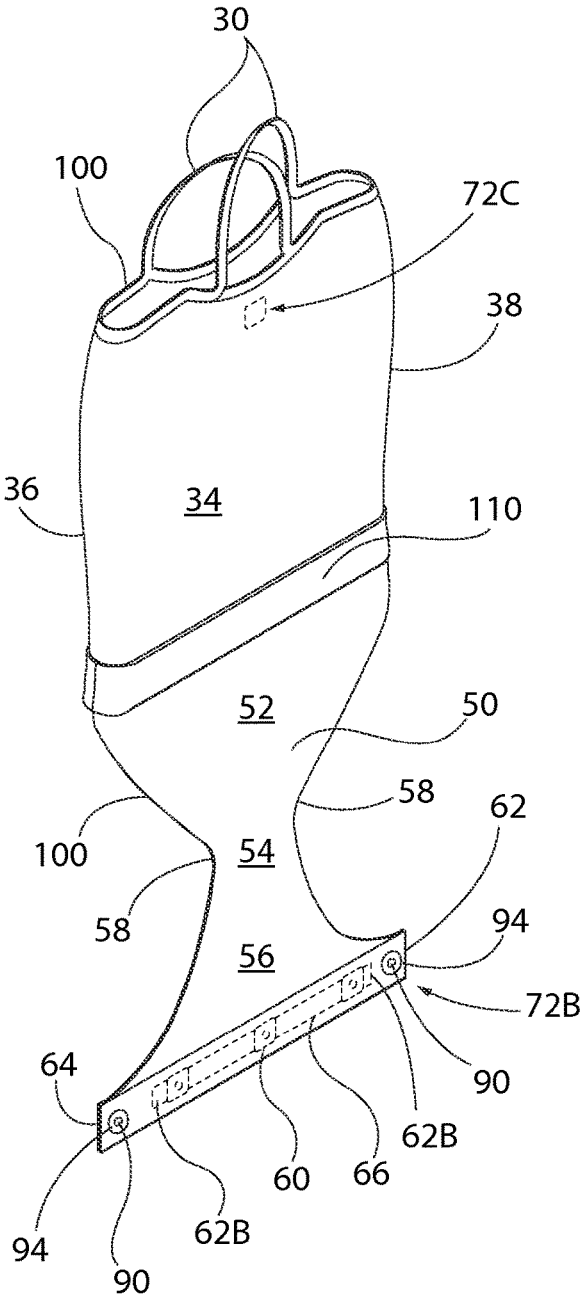
FIG. 4 is a perspective rear view of the swimsuit showing the fastening system including second and third magnetic assemblies for releasably fastening the flap portion in an opened position, according to the preferred embodiment of the present invention.
Figure 5A:
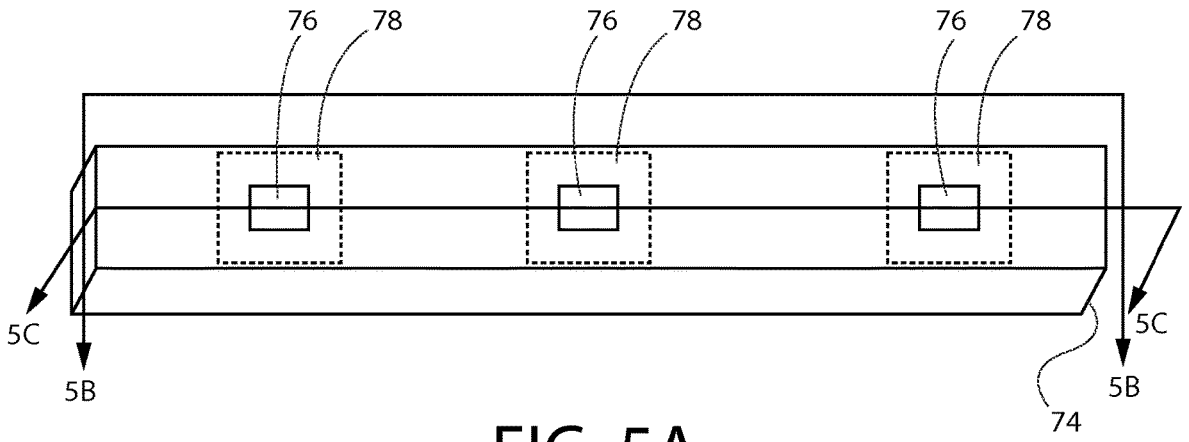
FIG. 5A is a perspective view of the first and second magnetic assemblies including a support element having a plurality of magnets attached thereto, according to the preferred embodiment of the present invention.
Figure 5B:
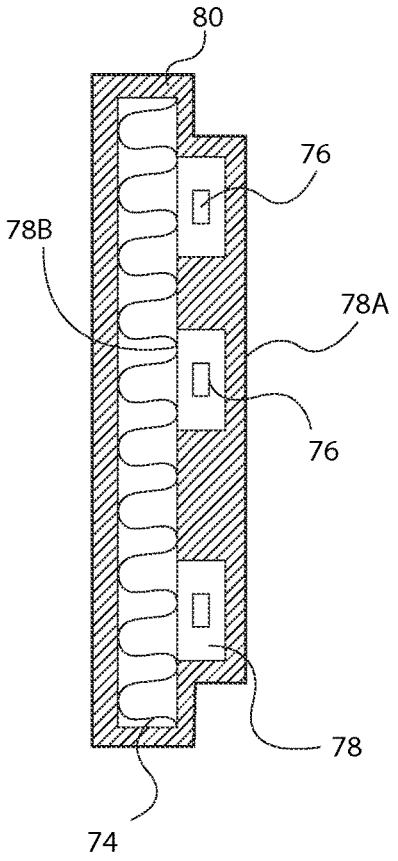
FIG. 5B is an exploded cross-sectional view of the support element of the first or second magnetic assembly taken along line 5B-5B of FIG. 5A, according to the preferred embodiment of the present invention.
Figure 5C:
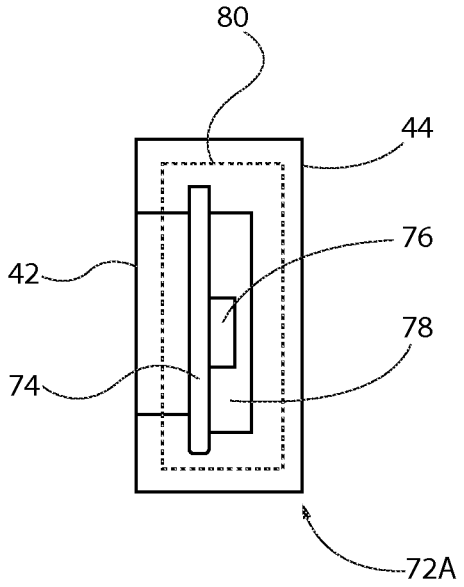
FIG. 5C is an exploded cross-sectional view of the support element of the first magnetic assembly taken along line 5C-5C of FIG. 5A, according to the preferred embodiment of the present invention.
Figure 5D:
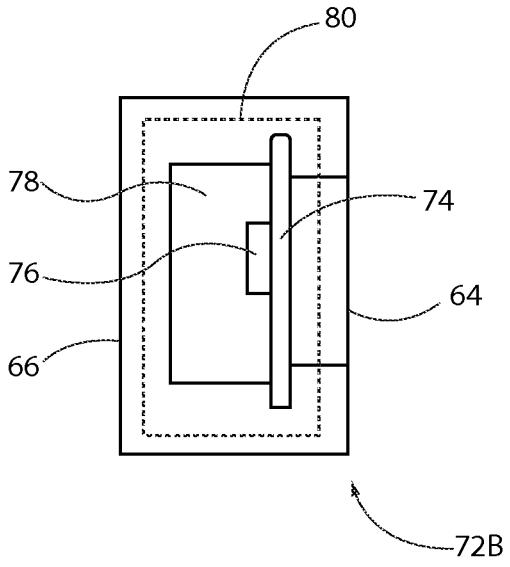
FIG. 5D is an exploded cross-sectional view of the support element of the second magnetic assembly taken along line 5D-5D of FIG. 5A, according to the preferred embodiment of the present invention.
Figure 5E:
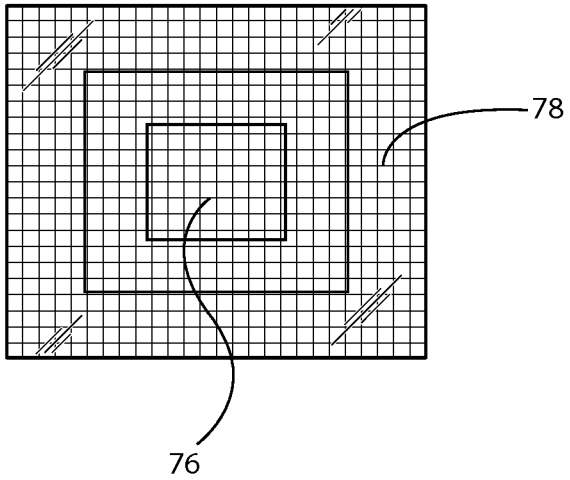
FIG. 5E is an exploded plan view of the magnetic element encased within a plastic pocket, according to the preferred embodiment of the present invention.
Figure 6:
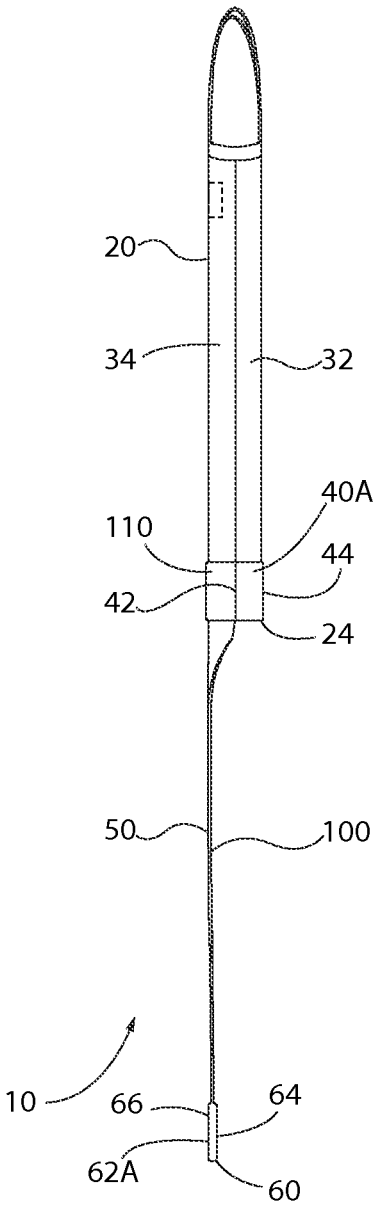
FIG. 6 is a side elevational view of the swimsuit of FIG. 3, according to the preferred embodiment of the present invention.

Referring to FIGS. 3-4, the main body section 12 includes a first panel 32 and a second panel 34, which may be connected together at side seams 36, 38. Preferably, the first panel 32 covers the front of the child and the second panel 34 covers the back of the child. It should be noted that in other embodiments the first and second panels 32, 34 may be interchanged. The front panel 32 extends to the lower edge 24 that is approximately at hip level when the female child wears the swimsuit 10. The lower edge 24 of the main body section 12, along at least the front portion 32, includes a first band portion 40 extending from one hip to another across the abdomen of the child. Preferably, the first band portion 40 extends from one side seam to the other side seam 36, 38 and includes an interior area 40A defined between an underside and outer side 42, 44. The back portion 34 of the main body section 12 extends downwardly below the plane of edge 24 to form the crotch flap portion 50. The flap portion 50 includes a seat portion 52, which covers the buttocks area of the child, a narrow strip portion 54 which extends from the seat portion and extends along the crotch area of the child, and a substantially wide triangular portion 56 adapted to cover the abdomen and pelvis area of the child. The seat, strip, and triangular portions 52, 54, 56 are configured such that when the swimsuit is worn by the child, the edges 58 will form leg openings 16 fitting relatively snuggly around the child's upper legs.

The triangular portion 56 has an upper edge 60, which includes a second band portion 62 having an interior area 62A defined between a top and bottom side 64, 66. The topside 66 of the second band portion 62 secures to the underside 42 of the first band portion 40 when the swimsuit is in a closed position (shown in FIG. 7A). In the closed position, the triangular portion 56 of the flap portion 50 covers the abdomen and pelvis regions.

A third band portion 110 may for aesthetic reasons extend from one side seam 36 to the other side seam 38 across the lower back of the child, such that the first and third band portions 40, 110 resemble one continuous band. For aesthetic purposes, the first, second, and third band portions 40, 62, 110, along with the top edge 22 and straps 30 of the main body are color coordinated.

Figure 7A:
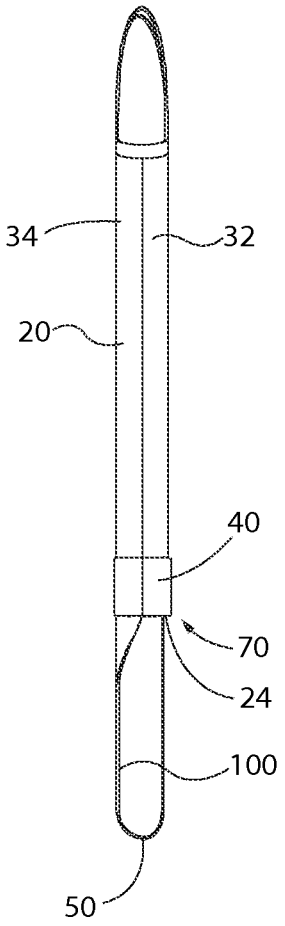
FIG. 7A is a side elevational view of the swimsuit of FIG. 3, shown in the closed position wherein the first magnetic assembly is aligned and releasably fastened on top of the second magnetic assembly, according to the preferred embodiment of the present invention.

The fastening system 70 includes two complimentary magnetic assemblies, including a first magnetic assembly 72A and a second magnetic assembly 72B, which cooperate with one another and are magnetically opposable to secure and releasably fasten opposing closure surfaces, namely the lower edge 24 and upper edge 60 of the swimsuit 10. The first and second magnetic assemblies 72A, 72B are concealed within the interior 40A, 62A of the first and second band portions 40, 62 respectively. The first magnetic assembly 72A, 72B is housed between the underside and outer side 42, 44 of the first band portion 40, adjacent the lower edge 24 of the front portion 32 of the swimsuit 10. The second magnetic assembly 72B is housed between the bottom side and topside 64, 66 of the second band portion 62, adjacent the upper edge 62 of the flap portion 50. Referring to FIG. 7A, the underside 42 of the first band portion 40 releasably secures transversely over the topside 66 of the second band portion 62 when the flap is in the closed position. The result is a fastening system 70 that is securely closed in a direction normal to the plane of engagement between the edges 24, 62.

Figure 7B:
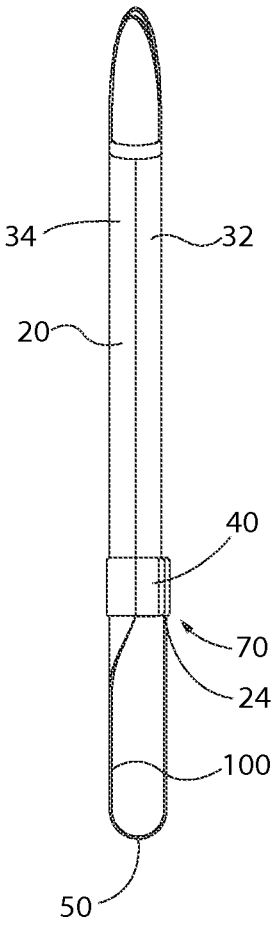
FIG. 7B is a side elevational view of the swimsuit of FIG. 3, shown in the closed position wherein the second magnetic assembly is aligned and releasably fastened on top of the first magnetic assembly, according to a second embodiment of the present invention.

Referring to FIG. 7B, a second embodiment is illustrated wherein the flap portion 50 is closed in an alternative configuration. Here, the bottom side 64 of the second band portion 62 releasably secures transversely over the outer side of the first band portion 40.

Figure 8:
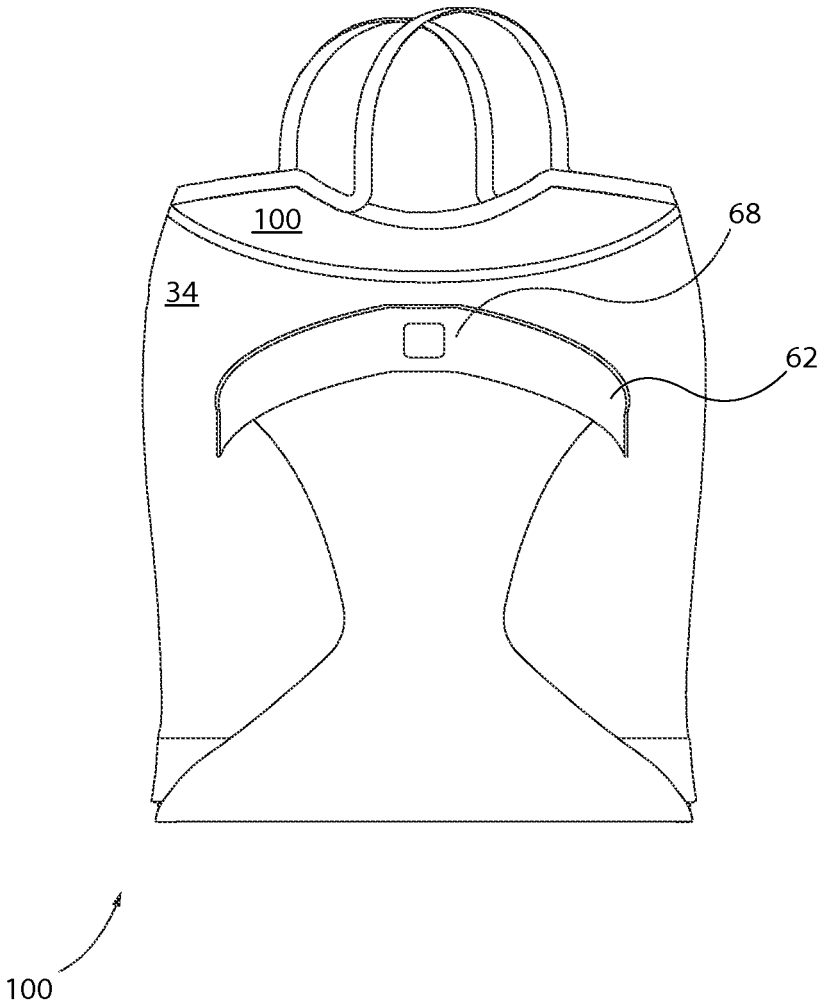
FIG. 8 is a perspective rear view of the swimsuit including the flap portion in the opened position, wherein the second magnetic assembly is releasably fastened to the third magnetic assembly, according to the preferred embodiment of the present invention.

The fastening system 70 also includes a third magnetic assembly 72C, which is complimentary with the second magnetic assembly 72B, when the second magnetic assembly is disengaged from the first magnetic assembly. Referring to FIG. 8, the second and third magnetic assemblies are magnetically opposable to secure at least one portion 68 of the topside 66 of the second band portion 62 of the flap to the back portion 34 of the swimsuit 10 so that the flap is held up and out of the way.

Referring to FIGS. 5A-5E, the first and second magnetic assemblies 72A, 72B are each housed within the interior 40A, 62A of the first and second bands 40, 62. Each of the first and second assemblies has a support element 74, preferably an elongated thin flexible strip or other like elastic, stretchable, or bendable fabric material. The support strip 74 includes a plurality of flat magnetic discs or other permanent magnets, or a strip or slab of magnetic material 76, secured thereto. Preferably, the magnetic material 76 is held within pockets 78, or envelope-like receptacles, which are secured to the support strip 74 in the first and second magnetic assemblies 72A, 72B. Alternatively the magnets may be sewn or glued directly onto the support strip.

The pockets 78 are formed from a top and bottom layer 78A, 78B of polyvinyl chloride plastic, which is heat sealed around the magnetic material 76, to create the pocket for securely housing the magnetic material therein. This configuration provides a waterproof casing for the magnets and provides a high resistance to potential corrosion.

The magnetic material can include any magnetic material, object or item that produces a magnetic field. This includes ceramics or metals, including, ferrites, cobalt, hematite, iron, nickel, carbon steel, stainless steel, and other known materials. Common non-limiting combinations include neodynium-iron-boron compounds, samarium-cobalt compounds, aluminum-nickel-cobalt compounds, manganese-aluminum compounds or other known mixtures thereof.

After the magnetic material is secured within the pocket 78, the pockets 78 are fastened directly onto the support strip 74. Preferably, the pockets 78 are sewn to the support strip 74 by stitching, or secured thereto by adhesive or any other known means. The pockets 78 and support strip 74 are then covered in a stabilizing cover layer 80, preferably a fusable mesh material. The stabilizing cover layer 80 may be heat sealed, or ironed, to secure the stabilizing cover layer onto the support strip 74 and/or pockets 78 for adding a degree of stiffness and eliminating movement of the strip 74 within the interior of the band. In alternate embodiments, other known stabilizing elements and/or materials may be used.

The magnetic material 76 of the third magnetic assembly 72C is held within pocket 78. The pocket 78 is secured to the back portion 34 of the swimsuit, as shown in FIG. 8. Preferably, the magnetic material 76 housed within a polyvinyl chloride plastic pocket 78 and is secured between the lining 100 and back portion 34 of the swimsuit, substantially adjacent the upper edge 22 and substantially centered between the seams 36, 38. In alternate embodiments, the pocket 78 may be attached to any convenient area of the tubular member or flap portion.

Referring to FIG. 8 which illustrates the flap portion in the opened position. The flap portion is capable of folding backward and extending between the child's legs beneath the crotch of the child and securing at the third magnetic assembly at the back portion 34 of the swimsuit.

In the opened position, the flap portion 50 exposes the bottom and buttocks of the child and provides the child the ability to use the bathroom without interference from the swimsuit.

Further fastening strength is provided in the swimsuit 10 by the inclusion of a pair of mechanical snap fasteners coupled to the free ends 40B, 62B of the first and second bands 40, 62 respectively. The connection between the snap fasteners insures that the free ends 40B, 62B of the first and second bands 40, 62 remain aligned in position when the swimsuit is adorned and the first and second magnetic assemblies are 72A, 72B are opposably secured. Preferably, the snap fasteners 90 include closures having a female member 92 and male member 94. Preferably, at least one female member 92 is sewn by stitching to each free end 40B at the underside 42 of the first band portion 40. Preferably, at least one male member 94 is sewn by stitching to each free end 62B of the topside 66 of the second band portion 62. The snap fasteners may include any clasp or fastener that closes with a click, or other like sharp sound, including but not limited to post-style snaps, prong-style snap, spring snaps, and grip snaps.

Magnets useful in the present invention have a specific polarization or the magnets must be polarized for purposes of joining the magnetic assemblies of the present invention. A positively polarized magnet from the one magnetic assembly must meet a negatively polarized magnet from a cooperating magnet assembly for joining to take place. In the preferred embodiment, a positively polarized magnet from the first or third magnetic assembly must meet a negatively polarized magnet of substantially equal magnetic field strength from a cooperating second magnetic assembly for joining to take place. Thus if a positively polarized magnet from one magnetic assembly meets a positively polarized magnet from the other magnetic assembly, the magnets will repel one another and the bands will not close. Similarly, if a positively polarized magnet from a first or third magnetic assembly meets a negatively polarized magnet from the cooperating second magnetic assembly that has significantly greater or lesser magnetic field strength, the assemblies will not join or they may join but not remain joined for the length of time necessary. Substantially equal magnetic field strength shall mean magnetic field strength values in the same approximate range so that the oppositely charged magnets will attract each other, join and stay joined until releasably disengaged by the child wearing the swimsuit.

It should be noted that the positively and negatively polarized magnets are interchangeable, as long as opposite polarization is obtained between mating assemblies.

It should be noted that the preferred embodiment describes a swimsuit garment for wear by a young girl for illustrative purposes. Other like one-piece garments, non-limiting to body suits and leotards are also contemplated. In addition, all of these garments can be worn by infants, children, and adults, as well as men and women alike.

In other embodiments, an attractive magnetic force can be produced between a magnet and a magnetically susceptible material, such as iron, incorporated within the opposite mating assembly from the magnet.

It should be understood that numerous variations are possible, while adhering to the inventive concept. Such variations are contemplated as being a part of the present invention.

While only one preferred embodiment of the present invention has been disclosed for purposes of illustration, it is obvious that many modifications and variations could be made thereto. It is intended to cover all of those modifications and variations, which fall within the scope of the present invention as defined by the following claims.

We claim:

1. A one-piece garment, comprising:

a tubular member having a first panel and a second panel for substantially covering a torso of a wearer, the first panel connected to the second panel by first and second side seams, said first panel extending to a lower edge having a first band portion, said first band portion extending transversely from the first side seam at least to the second side seam across the abdomen of the wearer, said second panel comprising a top edge;

a flap portion having an upper edge, said flap portion extending downwardly from said second panel of said tubular member past the plane of the lower edge, said flap portion having an opened and a closed position, wherein the flap portion in the closed position forms a leg hole that comprises an upper apex and the first band portion is located above the upper apex, and the upper edge is secured behind the underside of the first band portion in the closed position; and at least one first fastener for releasably fastening said flap portion in said closed position, wherein said upper edge of said flap portion releasably engages said lower edge of said tubular member, wherein the second panel comprising at least one second fastener adjacent the top edge for releasably fastening said flap portion to the second panel in said open position.

2. The one-piece garment of claim 1, wherein the at least one first fastener comprises a pair of complimentary magnetic assemblies including a first magnetic assembly integrally coupled to the first panel of the tubular member, and a second magnetic assembly integrally coupled to the flap portion.

3. The one-piece garment of claim 2, wherein the first magnetic assembly has a first thin flexible strip having magnetic properties integrally formed within the lower edge of the first panel of the tubular member.

4. The one-piece garment of claim 3, wherein the second magnetic assembly has a second thin flexible strip having magnetic properties integrally formed within the upper edge of the flap portion, for fastening in the closed position the upper edge of the flap portion to the lower edge of the first panel of the tubular member.

5. The one-piece garment of claim 4, wherein the first and second strips provide overlapping engagement and attraction, such that the lower edge of the first panel of the tubular member substantially overlaps and conceals the upper edge of the flap portion in the closed position.

6. The one-piece garment of claim 2, wherein the at least one second fastener comprises a third magnetic assembly having magnetic properties.

7. The one-piece garment of claim 6, wherein the second magnetic assembly is releasably engaged to the third magnetic assembly when the flap portion is in the opened position.

8. The one-piece garment of claim 1, further comprising at least one first snap fastener secured to the first panel, and at least one second snap fastener secured to the flap portion, wherein the first snap fastener removably engages the second snap fastener to securely fasten the lower edge of the first panel to the upper edge of the flap portion when the flap portion is in the closed position.

9. A one-piece swimsuit for a female child having a torso and abdomen, comprising:

a tubular member having a front panel and a back panel for substantially covering the torso of the child, the front panel connected to the back panel by first and second side seams, said front panel extending to a lower edge having a first band portion, said first band portion having an outer side and an underside extending transversely from the first side seam at least to the second side seam across the abdomen of the child, said back panel comprising a top edge;

a flap portion having an upper edge, said flap portion extending downwardly from the back panel past the plane of said lower edge, said flap portion having an opened and closed position, said upper edge having a second band portion having a topside and a bottom side, wherein the flap portion in the closed position forms a leg hole that comprises an upper apex and the first band portion is located above the upper apex, and the upper edge is behind the underside of the first band portion in the closed position; and a fastening system for releasably fastening said flap portion in said opened and closed positions, said system having a first, second, and third magnetic assembly, wherein said second magnetic assembly is releasably fastened to said first magnetic assembly when said flap portion is in said closed position, wherein said second magnetic assembly is releasably fastened to said third magnetic assembly when said flap portion is in said opened position, and wherein the third magnetic assembly is centrally disposed adjacent the top edge of the back panel;

the first magnetic assembly having at least one first magnetic element disposed within said first band portion, the second magnetic assembly having at least one second magnetic element disposed within said second band portion, the third magnetic assembly having at least one third magnetic element disposed within said back panel of said tubular member, said first band portion being magnetically securable to said second band portion via said at least one first and second magnetic elements, said second band being magnetically securable to said third magnetic element via said at least one second and third magnetic elements.

10. The one-piece swimsuit of claim 9, wherein the first magnetic assembly includes a first elongated thin flexible strip integrally coupled within the first band portion and having the at least one first magnetic element coupled thereto.

11. The one-piece swimsuit of claim 10, wherein the at least one first magnetic element is encased within a pocket coupled to the first elongated thin flexible strip.

12. The one-piece swimsuit of claim 9, wherein the second magnetic assembly includes a second elongated thin flexible strip integrally coupled within the second band portion and having the at least one second magnetic element coupled thereto.

13. The one-piece swimsuit of claim 12, wherein the at least one second magnetic element is encased within a pocket coupled to the second elongated thin flexible strip.

14. The one-piece swimsuit of claim 9, wherein the closed position the first magnetic assembly is releasably fastened on top of the second magnetic assembly such that the underside of the first band portion is substantially aligned with the topside of the second band portion.

15. The one-piece swimsuit of claim 9, wherein the closed position the first magnetic assembly is releasably fastened underneath the second magnetic assembly such that the bottom side of the second band portion is substantially aligned with the outer side of the first band portion.

16. The one-piece swimsuit of claim 9, further comprising at least one first snap fastener secured to the underside of the first band portion, and at least one second snap fastener secured to the topside of the second band portion, wherein the first snap fastener removably engages the second snap fastener to securely fasten the lower edge of the front panel to the upper edge of the flap portion when the flap portion is in the closed position.

* * * * *